US008132504B2

(12) United States Patent
Thompson

(10) Patent No.: US 8,132,504 B2
(45) Date of Patent: Mar. 13, 2012

(54) SECURITY PRINTING WITH GEL INKS

(75) Inventor: Michael Donald Thompson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 817 days.

(21) Appl. No.: 12/199,178

(22) Filed: Aug. 27, 2008

(65) Prior Publication Data

US 2010/0053289 A1 Mar. 4, 2010

(51) Int. Cl.
*B31F 1/07* (2006.01)
*B41F 19/02* (2006.01)

(52) U.S. Cl. ..... 101/23; 101/32

(58) Field of Classification Search ..... 347/171, 347/102, 101; 101/3.1, 22, 23, 32
See application file for complete search history.

(56) References Cited

U.S. PATENT DOCUMENTS

| | | | | |
|---|---|---|---|---|
| 5,396,839 | A * | 3/1995 | Rice | 101/32 |
| 5,555,800 | A * | 9/1996 | Rice | 101/23 |
| 5,643,678 | A | 7/1997 | Boswell | |
| 5,797,632 | A * | 8/1998 | Rice | 283/114 |
| 6,139,066 | A | 10/2000 | Mowry et al. | |
| 7,131,775 | B2 | 11/2006 | Uchida et al. | |
| 7,168,868 | B2 | 1/2007 | Uchida et al. | |
| 2006/0201364 | A1 | 9/2006 | Simske et al. | |
| 2007/0120930 | A1 | 5/2007 | Domoto et al. | |
| 2008/0000384 | A1 * | 1/2008 | Belelie et al. | 106/31.13 |
| 2008/0122914 | A1 | 5/2008 | Toma et al. | |

FOREIGN PATENT DOCUMENTS

| | | | | |
|---|---|---|---|---|
| FR | 2211885 | | 7/1974 | |
| JP | 59-174667 | * | 10/1984 | 524/853 |
| WO | 0204234 | A1 | 1/2002 | |
| WO | 2005051675 | A2 | 6/2005 | |

* cited by examiner

*Primary Examiner* — Huan Tran
(74) *Attorney, Agent, or Firm* — Pepper Hamilton LLP

(57) ABSTRACT

A method and system of embossing ink including applying the ink to a print substrate, applying an embossing substrate to the ink wherein the embossing substrate imprints a predetermined pattern into the ink, and curing, via a radiation source, the ink such that an imprint of the predetermined pattern is embossed in the ink.

19 Claims, 3 Drawing Sheets

SECURITY PRINTING WITH GEL INKS

BACKGROUND

The present disclosure relates to manufacture of printed packages or secure documents. More specifically, the present disclosure relates to secure printing by embossing patterns or signatures into a printed package or packing seal.

Counterfeiting is a serious problem affecting nearly all aspects of the manufacturing industry. In efforts to prevent counterfeiting, many manufacturers started to add security features to packaging. One security feature involves branding, or stamping, a product with a licensed image or trademark that indicate the manufactured item is a genuine product of the manufacturer. However, this approach merely slows counterfeiters while they also change their manufacturing processes and techniques to duplicate the changes made by the genuine manufacturers.

Counterfeiting is particularly widespread in the pharmaceutical industry. With the advance of foreign manufacturers and Internet pharmacies, counterfeit medications are becoming a serious threat to the pharmaceutical industry. Counterfeit drugs are sometimes made from different or inferior products that could cause detrimental effects in a patient. In some extreme cases, a patient could even die after receiving a counterfeit medication that is not correctly manufactured or is labeled incorrectly.

To avoid confusion with counterfeited goods, many pharmaceutical companies started to manufacture custom packaging with printed seals, which indicate authenticity. These printed seals enclose the caps or lids of the medication bottles, and include a stamping or printing from the manufacturer. However, this approach merely deterred some counterfeiters, who, after a period of time, began copying the printed seals as well, thereby producing an accurate packing containing counterfeit medications.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to an "ink" is a reference to one or more inks and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In an embodiment, a method of embossing ink may include applying the ink to a print substrate, applying an embossing substrate to the ink wherein the embossing substrate imprints a predetermined pattern into the ink, and curing, via a radiation source, the ink such that an imprint of the predetermined pattern is embossed in the ink.

In an embodiment, a system for creating a securely printed document may include a curing station. The curing station may include a combiner configured to press a printing substrate and an embossing substrate together; a curing source configured to expose a radiation source to the combined substrates; and a divider configured to separate the printing substrate from the embossing substrate. The system may also include a first feeder configured to feed the printing substrate with an applied amount of ink into the curing station and a second feeder configured to feed the embossing substrate with an applied predetermined pattern of at least one impression or depression into the curing station.

In an embodiment, a method of embossing ink may include creating a predetermined pattern on an embossing substrate, applying the ink to a print substrate, applying the embossing substrate to the ink wherein the embossing substrate imprints the predetermined pattern into the ink, and curing, via a radiation source, the ink such that an imprint of the predetermined pattern is embossed in the ink.

BRIEF DESCRIPTION OF THE DRAWINGS

Aspects, features, benefits and advantages of the present invention will be apparent with regard to the following description and accompanying drawings, of which.

DETAILED DESCRIPTION

For purposes of the discussion below, an "assembly" refers to a printer, a copier, a multifunction machine or system, a xerographic machine or system, or any other type of printing apparatus that is capable of curing an ink on a printing substrate.

A "printing substrate" refers to a physical sheet of paper, plastic and/or other suitable substrate for printing images thereon.

An "embossing substrate" refers to a physical sheet of paper, plastic and/or other suitable substrate for embossing a pattern into an amount of ink applied to a printing substrate.

Figure 1:
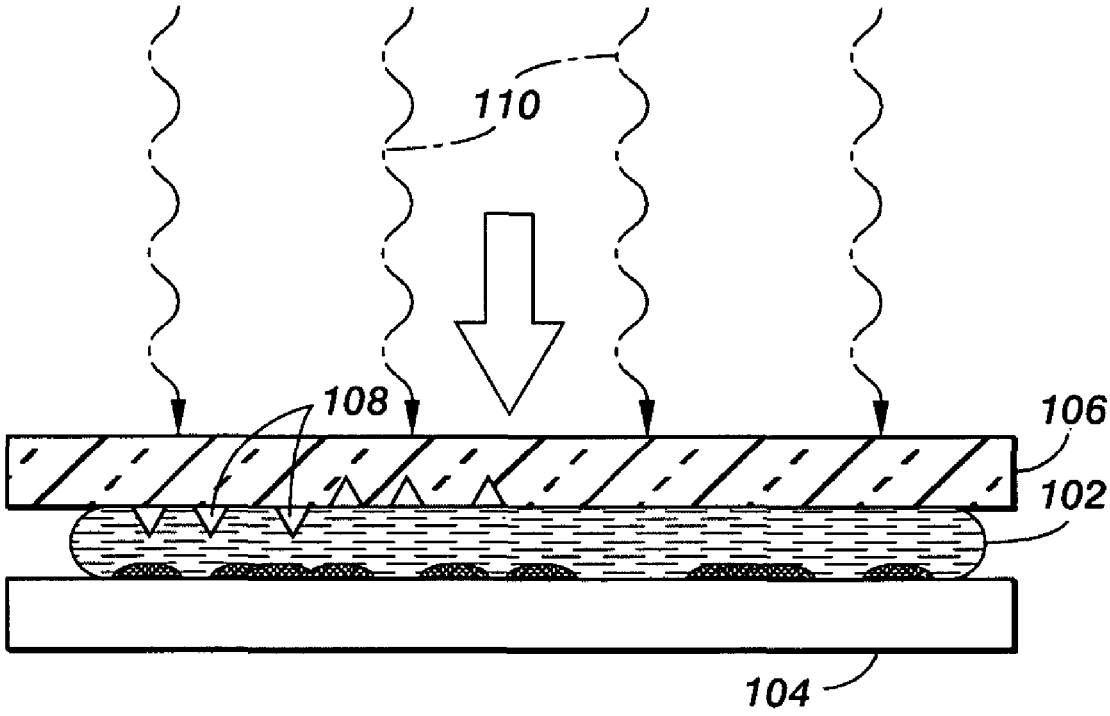
FIG. 1 illustrates various embodiments of a printing and embossing configuration.

FIG. 1 illustrates a side view of one embodiment of a printing and embossing configuration. The configuration may be implemented at an ink curing station (e.g., an ultraviolet (UV) curing station or a thermal curing station). An amount of ink 102 is applied to a print substrate 104. The ink may be a gel ink such as, for example, Xerox® UV Gel ink. A gel ink is a high viscosity fluid with a sharp melting point. Due to their higher viscosity, gel inks tend to sit on top of a cool substrate, even porous substrates such as paper, as compared to standard inks. By curing the ink with a radiation source, such as UV light or thermal radiation, the gel ink solidifies on top of the print substrate without need for drying. Typically, these properties are achieved by combining at least first and second chemically distinct gellants. When exposed to a curing source (e.g., ultraviolet light), the two distinct gellants chemically bond to each other, thereby curing the ink. Gel inks are further explained in U.S. patent application Ser. No. 11/291,284 and U.S. patent application Ser. No. 11/466,687, each of which is hereby fully incorporated by reference.

An embossing substrate 106 is applied on top of the ink 102, sandwiching the ink between print substrate 104 and the embossing substrate. A downward pressure is applied to the embossing substrate 106, illustrated in FIG. 1 by the arrow. Embossing substrate 106 may contain a series of impressions and/or depressions 108. These impressions/depressions 108 may be used to create a predetermined pattern on the embossing substrate 106 which is then imprinted or embossed into ink 102.

Another component of the printing and embossing configuration illustrated in FIG. 1 is a curing radiation source, such as a UV curing source 110. UV curing source 110 is arranged such that the UV light may be directed toward the ink 102. It is important to note that when using a light based radiation source, such as UV curing source 110, embossing substrate 106 should be made from a material that is transparent to UV radiation. Similarly, when using a thermal radiation source such as a high heat emitting device, the embossing substrate 106 should be made from a material that provides little or no insulation from heat reaching the ink 102. If the embossing substrate 106 is not transparent to the curing radiation, the ink 102 will not cure. The printing, embossing and curing mechanisms and methods are discussed in greater detail in the following discussions of FIG. 2 and FIG. 3.

Figure 2:
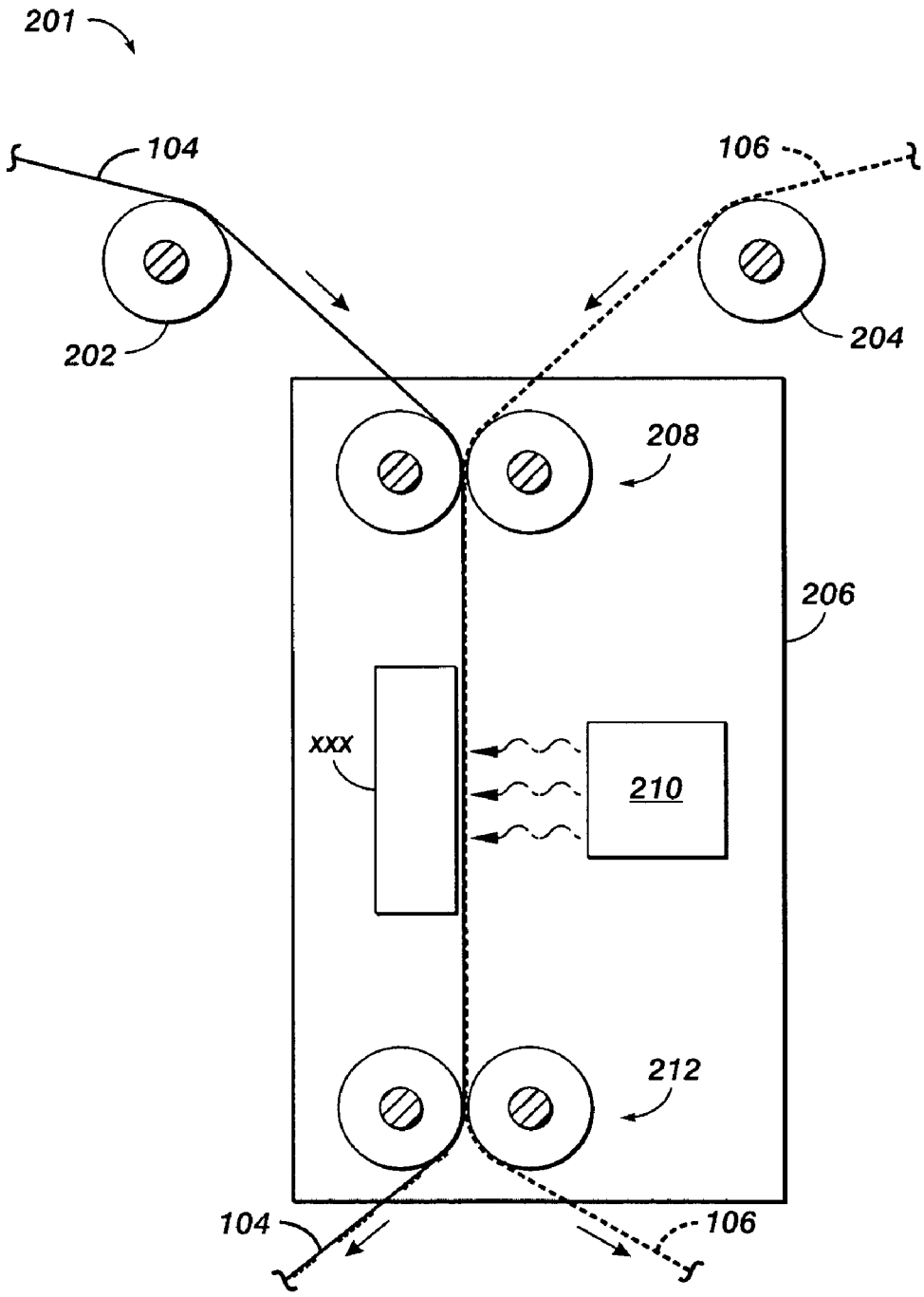
FIG. 2 illustrates various embodiments of a manufacturing assembly including the printing and embossing configuration of FIG. 1.

FIG. 2 illustrates a manufacturing assembly 201 including the printing and embossing configuration illustrated in FIG. 1. The manufacturing assembly 201 may be used to produce a printed security seal, document, or any printed materials including ink embossed with a unique pattern.

Manufacturing assembly 201 includes two material pathways, one for the printing substrate 104 and one for embossing substrate 106. Printing substrate 104 enters the assembly 201 via feeder 202. Similarly, embossing substrate 106 enters the assembly 201 via feeder 204. Both feeder 202 and feeder 204 feed their respective substrates into curing station 206. In this example, an amount of ink 102 is already applied to printing substrate 104; however, an additional component may be present in the manufacturing assembly for applying the ink. Similarly, in this example, a predetermined pattern of impressions and/or depressions 108 is already applied to embossing substrate 106; however, an additional component may be present in the manufacturing assembly for creating the predetermined pattern on the embossing substrate.

The curing station 206 may include a combiner 208, a curing source 210 and a divider 212. Combiner 208 receives the printing substrate 104 and the embossing substrate 106 and presses them together. In an embodiment, curing source 210 may include a UV curing source 110 as discussed above in reference to FIG. 1. Divider 212 divides the pressed together substrates resulting in a printing substrate 104 with cured ink 102 and a used embossing substrate 104. The actual steps taken during the manufacturing, and resulting printing and embossing, are discussed below in greater detail with regard to FIG. 3.

Figure 3:
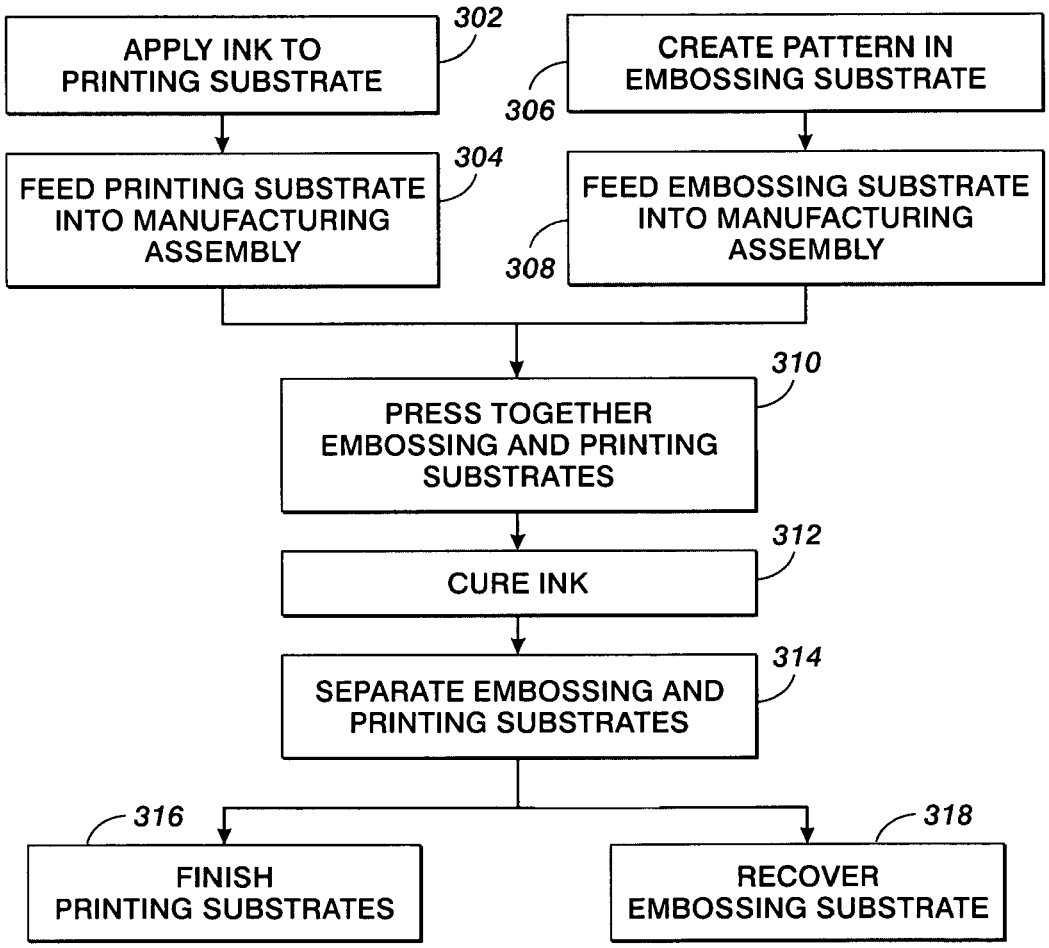
FIG. 3 illustrates various embodiments of a printing and embossing method.

FIG. 3 illustrates an exemplary flowchart illustrating the steps taken during the manufacturing process performed by assembly 201. The flowchart illustrates the two separate paths taken by the separate substrates. The printing substrate is illustrated on the left of the flowchart, the embossing substrate is illustrated on the right on the flowchart and common steps are illustrated in the middle of the flowchart.

As shown in FIG. 3, the ink is applied 302 to the printing substrate. The thickness of the applied 302 ink may be determined by the pattern to be embossed. As discussed above, the ink may be a gel ink, and in this example, the ink is a UV curable gel ink. Typically, the applied ink may also be a monomer, or a series of non-bonded particles freely flowing with respect to each other.

After the ink is applied to the printing substrate, the printing substrate is fed 304 into the manufacturing assembly. For this example, printing substrate 104 (including applied ink 102) may be fed 304 into assembly 201 by feeder 202.

As further shown in FIG. 3 a predetermined pattern is created 306 in the embossing substrate. It should be noted that this may be done in advance of the manufacturing process as the creation of the predetermined pattern in the embossing substrate may be an involved process. The predetermined pattern may be created 306 by a micro-dot printing technique. In a micro-dot printing technique, tiny drops of ink are printed onto a surface in a predetermined pattern. Similarly, a predetermined pattern may be scratched or etched into the embossing substrate. Once the predetermined pattern is created 306 on the embossing substrate, the embossing substrate is wound onto a reel for feeding into the manufacturing assembly.

Once the pattern is created and the embossing substrate is wound, the embossing substrate may be unwound from the reel and fed 308 into the manufacturing assembly. To continue the example discussed above, embossing substrate 106 (including impressions/depressions 108) may be fed 308 into assembly 201 by feeder 204.

When both substrates (i.e., printing and embossing) are fed into the assembly, the two substrates are pressed together 310 to enclose the ink on two opposite sides, sandwiching the ink between the two substrates. The two substrates proceed through the manufacturing assembly simultaneously at a substantially similar speed. In the present example, printing substrate 104 may be pressed together 310 with embossing substrate 106 by combiner 208 of assembly 201, thereby sandwiching ink 102 between the two substrates. Once pressed together, the two substrates may pass the curing source 210 (e.g., a UV curing source) simultaneously. In this example, the predetermined pattern on the embossing substrate 106 is facing the ink 102, thereby transferring the predetermined pattern into the ink.

Once the substrates are pressed together 310, the combined substrates are exposed to a radiation source, and the ink applied to the printing substrate may be cured 312. Continuing with the present example, the combined substrates reach the curing source 210 of assembly 201. For example, a UV curing source emits a UV light. The UV light passes through embossing substrate 106 and cures 312 ink 102. During the curing process, any pattern included on embossing substrate 106 (e.g., impressions/depressions 108) is embossed into the ink 102. As it cures 312, the ink 102 undergoes a molecular change from a monomer to a polymer. During the curing 312, the ink particles form interconnecting bonds, thereby adding a rigidity to the ink 102, resulting in a cured ink.

The two substrates may then be separated 314. To continue with the above example, the substrates continue through assembly 201 to divider 212 where the substrates are separated 314.

The process illustrated in FIG. 3 again splits into two paths, one for each substrate. Finishing operations may be performed 316 on the printing substrate. For example, the printing substrate may be cut to appropriate lengths for labels, have an adhesive applied to create a seal, and/or various other finishing operations.

The embossing substrate may be recovered 318 and rewound onto a roll. Depending on the condition of the embossing substrate, and the desires of the manufacturer, the embossing substrate may be re-used for the embossing of another length of printing substrate.

It should be noted that the above processes and assemblies provide a manufacturing environment in which security and control features may be quickly and easily altered. By simply changing the pattern of the embossing substrate, a new security feature may be added to the printed substrate. This may enable a manufacturer to quickly change the security features provided with a product should a counterfeiter find a way to reproduce the original pattern embossed in the ink.

For example, a pharmaceutical company may emboss a pattern into the seals they include on their products by using the process described above. For security, every month (or any desired period of time), the manufacturer may change the pattern of the embossing substrate, thereby resulting in an updated seal with a new security feature. By providing pharmacies (or other end users) with an indication of what the updated security feature is, counterfeiting may be reduced as pharmacies know what security features to look for in genuine products. Similarly, by changing the security feature often, counterfeiters do not have an opportunity to duplicate the security feature because the genuine manufacturer may have changed the security feature by the time the counterfeit products with a copied security feature reach the market.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of embossing ink, the method comprising:

applying ink to a print substrate;

feeding, via a first feeder, the print substrate into a curing station;

feeding, via a second feeder, an embossing substrate into the curing station;

applying, via a combiner, the embossing substrate to the ink wherein the embossing substrate imprints a predetermined pattern into the ink;

curing, via a radiation source, the ink such that an imprint of the predetermined pattern is embossed in the ink; and separating, via a divider, the print substrate from the embossing substrate.

2. The method of claim 1, wherein the curing, via a radiation source, the ink such that an imprint of the predetermined pattern is embossed in the ink comprises:

curing the ink with an ultraviolet radiation source.

3. The method of claim 1, wherein the curing, via a radiation source, the ink such that an imprint of the predetermined pattern is embossed in the ink comprises:

curing the ink with a thermal radiation source.

4. The method of claim 1, further comprising:

creating the predetermined pattern on the embossing substrate.

5. The method of claim 4, wherein the creating the predetermined pattern on the embossing substrate further comprises:

micro-dot printing a series of ink drops onto the embossing substrate.

6. The method of claim 5, wherein creating the predetermined pattern on the embossing substrate further comprises:

creating at least one of an impression and a depression on the embossing substrate.

7. The method of claim 1, wherein the ink is a gel ink.

8. A system for creating a securely printed document, the system comprising:

a curing station, comprising:

a combiner configured to press a printing substrate and an embossing substrate together;

a curing source configured to expose a radiation source to the combined substrates; and a divider configured to separate the printing substrate from the embossing substrate;

a first feeder configured to feed the printing substrate with an applied amount of ink into the curing station; and a second feeder configured to feed the embossing substrate with an applied predetermined pattern of at least one of an impression and a depression into the curing station.

9. The system of claim 8, wherein the combiner is further configured to:

press the printing substrate and the embossing substrate together such that the applied ink is between the printing substrate and the embossing substrate.

10. The system of claim 9, wherein the divider is further configured to:

divide the printing substrate from the embossing substrate such that the applied ink remains on the printing substrate.

11. The system of claim 8, wherein the curing source is further configured to:

expose an ultraviolet radiation source to the combined substrates.

12. The system of claim 8, wherein the curing source is further configured to:

expose a thermal radiation source to the combined substrates.

13. The system of claim 8, wherein the applied predetermined pattern further comprises:

a series of ink drops micro-dot printed onto the embossing substrate.

14. The system of claim 8, wherein the ink is a gel ink.

15. A method of embossing ink, the method comprising:

creating a predetermined pattern on an embossing substrate;

applying the ink to a print substrate;

feeding, via a first feeder, the print substrate into a curing station;

feeding, via a second feeder, the embossing substrate into the curing station;

applying, via a combiner, the embossing substrate to the ink wherein the embossing substrate imprints the predetermined pattern into the ink;

curing, via a radiation source, the ink such that an imprint of the predetermined pattern is embossed in the ink; and separating, via a divider, the print substrate from the embossing substrate.

16. The method of claim 15, wherein the curing, via a radiation source, the ink such that an imprint of the predetermined pattern is embossed in the ink comprises:

curing the ink with an ultraviolet radiation source.

17. The method of claim 15, wherein the curing, via a radiation source, the ink such that an imprint of the predetermined pattern is embossed in the ink comprises:

curing the ink with a thermal radiation source.

18. The method of claim 15, wherein creating the predetermined pattern on the embossing substrate further comprises:

creating at least one of an impression and a depression on the embossing substrate.

19. The method of claim 15, wherein the ink is a gel ink.

* * * * *